United States Patent [19]

Reusser

[11] 4,125,089

[45] Nov. 14, 1978

[54] APPARATUS FOR TREATING PIPES

[76] Inventor: Peter U. Reusser, Gruebstrasse 25, Meilen, Switzerland

[21] Appl. No.: 772,921

[22] Filed: Feb. 28, 1977

[30] Foreign Application Priority Data

Mar. 1, 1976 [CH] Switzerland ..... 2517/76

[51] Int. Cl.[2] ..... B05C 7/08

[52] U.S. Cl. ..... 118/408; 118/105; 118/DIG. 10; 138/97

[58] Field of Search ..... 118/408, DIG. 10, 105; 138/97

[56] References Cited

U.S. PATENT DOCUMENTS

| | | | |
|---|---|---|---|
| 1,787,126 | 12/1930 | Steinnes | 118/DIG. 10 |
| 2,856,004 | 10/1958 | Badger | 118/408 X |
| 3,111,431 | 11/1963 | Weaver | 118/408 X |
| 3,135,629 | 6/1964 | McLean | 118/408 |
| 3,188,371 | 6/1965 | Weekley | 118/408 X |
| 3,269,421 | 8/1966 | Telford et al. | 118/408 X |

*Primary Examiner*—John P. McIntosh

*Attorney, Agent, or Firm*—Roylance, Abrams, Berdo & Farley

[57] ABSTRACT

Highly viscous treatment compound is applied to the interior of a pipe at selected locations by a tool passing through the pipe. The tool has axially spaced wall-contacting gaskets defining a pressure chamber therebetween into which the compound is forced. At least one of the gaskets is held in contact with the pipe wall by a support ring to counter the pressure of the compound in the chamber. The ring is withdrawn to permit movement of the tool. Specific apparatus for carrying the compound to and through the tool and for applying the pressure and operating the support means is disclosed.

6 Claims, 1 Drawing Figure

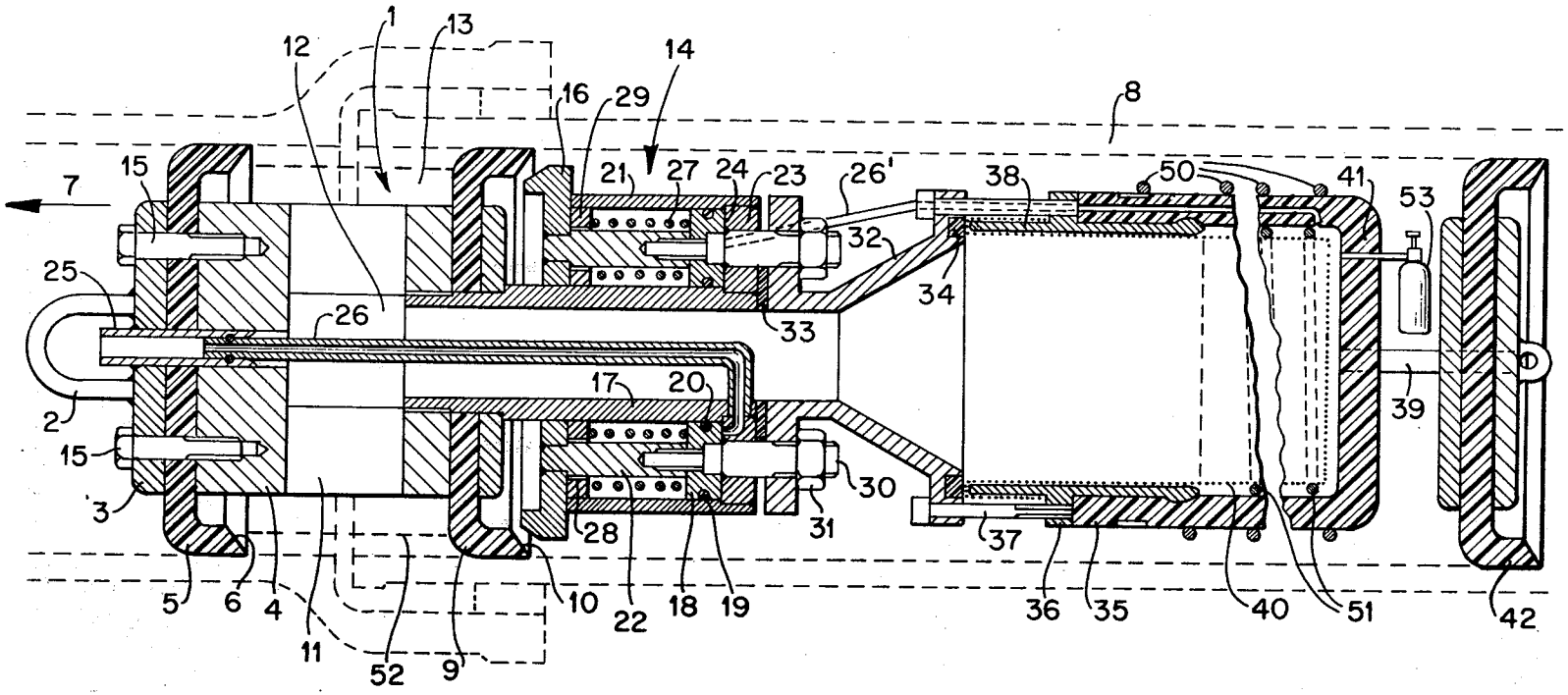
42
53
39
41
51
40
50
8
35
36
38
37
34
26'
32
30
31
33
23
24
19
27
18
14
20
22
29
21
17
28
16
10
13
9
1
52
26
12
11
4
6
5
15
3
7
25
2
15

APPARATUS FOR TREATING PIPES

This invention relates to apparatus for the treatment of inner parts of pipes and pipelines with preservatives for sealing compounds applied under pressure by a tool moved through the pipe.

BACKGROUND OF THE INVENTION

Various apparatuses are know for treating the inner parts of pipes and pipelines. The major differences between these apparatuses lie in the tool used for applying an essentially highly viscous preservative or sealing compound, the tools being moved by a suitable thrust means through the pipe length to be treated. The highly viscous compound is generally applied by centrifugal action or by pressure action. However, both types of application of the coating material have disadvantages. Thus, it is possible to centrifuge only those compounds, the viscosity of which is not too high. Since, however, sealing compounds must have very high viscosity, centrifuging can only be used in practice for coating inner walls.

Therefore, highly viscous compounds must be applied by pressure action. If, for this purpose, a circular extrusion nozzle is used, the necessary pressure is relatively high so that the production and controlling of very high pressure (of several hundred bars) is a costly matter, particularly when supplying the preservatives or sealing compounds from the outside. In addition, pressure extrusion is a continuous method although, in a relatively large number of applications, only particular areas of the inner wall have to be treated. This leads to a correspondingly and unnecessarily large consumption of preservatives or sealing compounds.

BRIEF SUMMARY OF THE INVENTION

An object of the invention is therefore to provide an improved apparatus for treating the interior of a pipe wherein the treatment is only carried out at desired locations and wherein a sparing use of the preservative or sealing compound is achieved without requiring a pressure higher than a few bars for the pressure action.

In accordance with the invention, there is provided apparatus for treating the interior of a tubular passage such as a pipeline with a preservative or sealing compound comprising the steps of passing through the passage a tool having an annular pressure chamber axially bounded by two sealing gaskets contacting the inner surface of the passage, stopping the tool at locations to be treated, applying pressure to at least one of the sealing gaskets, supplying the treatment compound under pressure to the pressure chamber, and removing the pressure from the at least one sealing gasket to permit the tool to be moved.

Also in accordance with the invention, there is provided an apparatus for treating the interior portions of a tubular passage such as a pipeline with a preservative or sealing treatment compound comprising a body movable through the passage, the body having a diameter significantly smaller than the passage; first and second axially spaced-apart gaskets carried by the body and extending outwardly to contact the interior surface of said passage to define a pressure chamber therebetween; and means for selectively applying sealing pressure to at least one of the gaskets to maintain contact of the gasket with the interior surface counter to the pressure of the treatment compound, and for relieving the sealing pressure to facilitate movement of the tool through the passage.

Normally, the second gasket (viewed in the direction of movement) is the one to which sealing pressure is selectively applied. Due to the special positioning of the second gasket, the tool can be moved without difficulty on depressurizing the pressure chamber despite the engagement of the gaskets on the inner wall.

BRIEF DESCRIPTION OF THE DRAWINGS

In order that the manner in which the foregoing and other objects are attained in accordance with the invention can be understood in detail, particularly advantageous embodiments thereof will be described with reference to the accompanying drawing which forms a part of this specification and which schematically shows a longitudinal section through a tool in accordance with the invention, which tool forms a part of the apparatus for treating the inner walls of pipes and pipelines.

DETAILED DESCRIPTION OF THE INVENTION

The apparatus comprises a drive and control apparatus such as a cable and winch by means of which the tool is drawn through the pipeline; locating or observation means, such as sensors or television cameras, permitting the detection or observation of the position of the tool and the area to be treated; and supply means, such as containers and associated conveying means, for supplying the preservative or sealing compound to the tool.

The tool 1 has at its front end a pulling loop 2 to which can be connected, for example, a cable hook of a cable winch. The pulling loop 2 is connected to a cover plate 3 which is attached to a tool body 4 by means of screws 15. Between cover 3 and tool body 4 is located a first front gasket 5 which extends radially outwardly from the tool and the peripheral portions of which extend axially away from the direction of movement of the tool, indicated by arrow 7, forming a sealing lip 6. Thus, the gasket extends between the tool to the inner surface of the pipeline 8 to be treated and forms a relatively tight seal therebetween. The first gasket 5 as well as a second use gasket 9, located rearwardly along the tool body 4, are made from a resilient material, such as an elastomer, so that they can without difficulty move over parts which project from the inner wall of pipeline 8, such as ends of pipe connections screwed into pipeline 8. The second gasket 9 is also cup-shaped and has a sealing lip 10 which points in the direction opposite the direction of movement 7 of tool 1.

Tool body 4 is provided with cavities 11 and 12, which can be radial openings, through which is pressed a preservative or sealing compound before it enters pressure chamber 13 formed by and between gaskets 5 and 9.

It is important that the sealing lips 6 and 10 of the two gaskets 5 and 9, respectively, are straightened, i.e., extend rearwardly, so that tool 1 can be moved without difficulty over obstacles on the inner wall. Since, however, pressure chamber 13 is pressurized, the second gasket 9 would not be able to seal the pressure chamber 13 by itself in the arrangement shown. That is, material would tend to collapse the second gasket as the pressure chamber 13 is pressurized, and the pressure chamber would therefore no longer be sealed. Accordingly, special supporting means 14 are provided for the purpose of applying pressure to the interior of sealing gasket 9. The supporting means comprises a thrust ring 16 which has a beveled outer edge and which surrounds a tube 17 screwed into tool body 4. An annular cylindrical piston 18 surrounds and is sealed against tool 17 by an O-ring 19. A cylindrical jacket 21 surrounds piston 18, the seal between the jacket and piston being provided by an O-ring 20. The piston is connected to and movable with the thrust ring by rods 22. A cylindrical chamber 24 is thus formed between members 17 and 21 and also a circular or annular cover plate 23, the chamber being subject to pressurization by a pressure medium, such as compressed air, through a conduit or pipe connection 25 which is fixed in cover 3 and a conduit line 26 connected to connection 25. Springs 27 surrounding rods 22 urge piston 18 toward the position shown in the figure. By means of the pressure which can be exerted on annular piston 18 from the right as seen in the figure, thrust ring 16 is pressed against sealing lip 10 counter to the action of springs 27, thereby supporting the sealing lip of gasket 9 from within, holding the gasket in firm contact against the inner surface of the pipe. Thus, pressure chamber 13 is perfectly sealed even when pressurized.

A guide plate 29 with bores 28 is screwed onto the cylindrical jacket 21.

Stay bolts 30 with nut 31 are fixed to circular cover 23 and serve to secure a container connection 32 to cover 23, this joint being sealed by a gasket 33. At the other end of container connection 32 is provided a further gasket 34, onto which is pressed a container 35 by tightening screws 37 which are screwed into an outer flange 36 of an end portion 38 connected with container 35. A smoothing sleeve 42 is fixed to the base 41 of container 35 by means of a connecting member 39. Sleeve 42, which is shaped and constructed similar to gaskets 5 and 9, serves to smooth the preservative or sealing compound applied to the inner wall.

Container 35 can be of any desired length, for example, several meters, and can also be constructed as a reinforced hose by uses indicated at 50. For the purpose of pressurizing container 35, a pressure medium line 26' leads from cylindrical chamber 24 to base 41 within container 35. The pressurization of container 35 can be delayed somewhat compared with the pressurization of cylindrical chamber 24, so that sealing lip 10 of the second gasket 9 is pressed outwardly against the inner wall of pipeline 8 by supporting means 14 before pressure chamber 13 is pressurized.

In order to simplify the operation of the tool, it is possible to keep the preservative or sealing compound ready in storage bags 40 and to introduce it into container 35 in this way. The edges of the bags can be folded back and placed against gasket 34 so that container 35 secures the bags in position. In addition, container 35 can have exterior guide means, such as rollers, not shown, so that it does not engage or "drag" on the inner wall of pipeline 8. As pressure chamber 13 which serves to treat the inner wall is located in front of container 35, the already mentioned arrangement of the downstream-located smoothing sleeve 42 can be necessary.

Tool 1 is moved through the pipeline with pressure chamber 13 depressurized and the piston and supporting means withdrawn so that the pressure against the interior of second gasket 9 is relieved. The area to be treated is detected by the sensing or observation means, not shown, and the tool 1 is then stopped when the pressure chamber 13 covers the area to be treated. The piston and supporting means is then actuated to support gasket 9 and the pressure chamber 13 is pressurized so that the preservative or sealing compound is pressed against the area to be treated, such as a pipe joint, until it is completely covered. Pressure chamber 13 is then depressurized and the gasket pressure is relieved so that the tool 1 can again be moved in the direction of moement 7 to the next point to be treated.

In place of a container, the preservative or sealing agent can also be supplied from the outside through a hose without any change in the above-described operation as a result. Pressurization can be furnished either by a compressor arranged on and carried by tool 1 or, alternatively, can be supplied from the outside. Pressure can also be supplied by a pressure medium container on tool 1, such as a container of compressed air 53. A television camera located in front of tool 1 is suitable for observation of the areas treated.

The cavities of tool body 4 can optionally be provided with filling members so that the volume of the preservative or sealing compound is reduced. In order to prevent an uneven compression of the bags which can be used for the easier handling of the preservative or sealing compound, a coil of wire 51 or other reinforcements, such as rings, can be placed therein. This tends to control the direction in which the bags collapse as they are subjected to pressure.

Despite depressurization, when tool 1 is moved, a certain amount of preservative or sealing compound will continue to adhere to the inner wall. If it is desired to reduce this amount still further, the pressure chamber 13 can be surrounded in sleeve-like manner by perforated members 52 and treatment under pressure can take place in the same way as described without the perforated portions. In the depressurized state, i.e., during movement or when tool 1 is stationary for a relatively long time, the discharge of highly viscous preservative or sealing compound is considerably reduced.

Supporting means 14 can also be constructed differently, for example, as a pressurizable hose. The essential point is that during the movement of tool 1, sealing lip 10 of the second gasket 9 is not pressed against the inner wall.

It is important that container 35 and bag 40 be flexible when the container is not pressurized so that it is possible for the tool to pass through pipelines which have curves or bends. Container 35 can also be constructed as a cylinder with a pressure-loaded plunger or with a rotary pressure pick-off, e.g., an extrusion screw. It is also possible to use a metering pump for pressurizing tool 1. In the latter two cases, a slight inlet pressure may optionally be necessary so that the preservative or sealing compound reliably enters and passes through tool 1.

Generally, the preservative or sealing compound drive and the mounting thereof on tool 1 is less expensive from the apparatus standpoint than is supplied to the tool 1 from the outside, i.e., outside the pipe 8 to be treated, through a line.

While certain advantageous embodiments have been chosen to illustrate the invention, it will be understood by those skilled in the art that various changes and modifications can be made therein without departing from the scope of the invention as defined in the appended claims.

What is claimed is:

1. An apparatus for treating the interior portions of a tubular passage such as a pipeline with a preservative or sealing treatment compound comprising a body movable through said passage in a predetermined direction, said body having a diameter significantly smaller than said passage;

front and rear axially spaced-apart gaskets carried by said body and extending outwardly to contact the interior surface of said passage and to define a pressure chamber therebetween, each of said gaskets being cup-shaped and having a flexible radially extending portion and a flexible annular portion extending axially rearwardly;

means for supplying treatment compouned under pressure to said pressure chamber, the annular portion of the front one of said gaskets being forced radially outwardly by said compound under pressure to contact said interior surface; and means for selectively applying sealing pressure to the rear one of said gaskets to maintain contact of said gasket with said interior surface counter to the pressure of said treatment compound and for relieving said sealing pressure to facilitate movement of said tool through said passage, wherein said means for applying sealing pressure includes an annular thrust ring axially displaceable toward and away from said axially extending portion of said rear gasket, piston means carried by said tool and connected to said thrust ring for moving said thrust ring against said gasket, and wherein said means for supplying compound under pressure further includes means for applying fluid under pressure to said piston means to move said piston means.

2. An apparatus according to claim 1 wherein said tool includes a treatment compound container and a connecting member connecting said container to said tool body and pressure chamber, and a pressure medium conduit connected to said container for selectively applying fluid under pressure to the treatment compound in said container.

3. An apparatus according to claim 2 wherein said conduit is also connected to said piston means in said means for applying sealing pressure to said rear one of said gaskets.

4. An apparatus according to claim 3 wherein said means for applying sealing pressure and said treatment compound container are connected in series with said pressure medium conduit.

5. An apparatus according to claim 2 wherein said means for applying treatment compound under pressure includes a flexible chamber, and wherein said flexible chamber includes a reinforced hose.

6. An apparatus according to claim 1 and further comprising a source of fluid under pressure carried by said tool.

* * * * *